US005206123A

United States Patent [19]

Ooms et al.

[11] Patent Number: 5,206,123

[45] Date of Patent: Apr. 27, 1993

[54] HIGH CONTRAST DEVELOPER CONTAINING AN APROTIC SOLVENT

[75] Inventors: Richard A. Ooms, Hofstade; Piet Kok, Gent, both of Belgium

[73] Assignee: Agfa-Gevaert, N.V., Mortsel, Belgium

[21] Appl. No.: 835,856

[22] Filed: Feb. 18, 1992

[30] Foreign Application Priority Data

Feb. 26, 1991 [EP] European Pat. Off. ..... 91200411

[51] Int. Cl.[5] ..... G03C 1/06

[52] U.S. Cl. ..... 430/264; 430/487; 430/493; 430/478; 430/481; 430/482; 430/265; 430/435; 430/440; 430/441; 430/442

[58] Field of Search ..... 430/265, 264, 487, 493, 430/478, 481, 482, 435, 440, 441, 442

[56] References Cited

U.S. PATENT DOCUMENTS

| | | | |
|---|---|---|---|
| 4,267,260 | 5/1981 | Muira et al. | 430/302 |
| 4,740,452 | 4/1988 | Okutsu et al. | 430/265 |
| 4,965,169 | 10/1990 | Hirano et al. | 430/265 |
| 5,004,670 | 4/1991 | Okutsu et al. | 430/265 |
| 5,039,591 | 8/1991 | Okutsu et al. | 430/265 |

*Primary Examiner*—Charles L. Bowers, Jr.
*Assistant Examiner*—Geraldine Letscher
*Attorney, Agent, or Firm*—Breiner & Breiner

[57] ABSTRACT

A method for high contrast development of an image-wise exposed photographic element comprising a support and at least one silver halide emulsion layer, which method comprises contacting said exposed element in the presence of a hydrazine compound with an aqueous alkaline developing solution which has a pH between 10 and 13 and contains a dihydroxybenzene developing agent a 3-pyrazolidinone or an aminophenol developing agent sulphite ions and a contrast promoting amount of an amino compound characterized in that said developing solution further contains an aprotic solvent corresponding to general formula (I) or (II) :

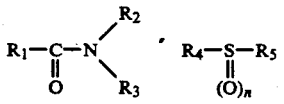

(I) (II)

wherein $R_1$ represents alkyl, substituted alkyl, alkylamino or substituted alkylamino, and $R_2$ and $R_3$ each independently represent alkyl substituted alkyl or wherein $R_1$ together with $R_2$ represent the necessary atoms to form together with the carbon and the nitrogen atom respectively to which they are attached, a heterocyclic ring, and $R_3$ represents alkyl substituted alkyl or hydrogen;

$R_4$ and $R_5$ each independently represent, alkyl, substituted alkyl, alkylamino or substituted alkylamino or $R_4$ together with $R_5$ represent the necessary atoms to form together with the sulphur atom to which they are attached a heterocyclic ring and n is 1 or 2.

Preferred aprotic solvents are N,N'-dimethylacetamide, N-methyl-2-pyrrolidinone tetramethylurea, 1,3,-dimethyl-2-imidazolidinone, dimethylsulphoxide and tetramethylenesulphon.

15 Claims, No Drawings

HIGH CONTRAST DEVELOPER CONTAINING AN APROTIC SOLVENT

FIELD OF THE INVENTION

The present invention relates to the field of black-and-white photography and more particularly to a method for the development of high contrast photographic elements such as lithographic materials used in graphic arts and to developing solutions suitable for this method.

SUMMARY OF THE INVENTION

In graphic arts reproduction processes the original image appearing to have a continuous tone gradation is reproduced by a collection of a large number of dots and/or lines. The tone of the reproduced image is influenced by both the size of the dots and lines and their density. A graphic arts film exposed in a way to exactly render the relative proportions of black and white in the original must produce dots and lines of sufficient density: another reason herefor is the fact that no substantial amount of copying light may be transmitted through the dots and lines in a further duplicating cycle. Therefor a photographic element showing high contrast or so-called "lith gradation" on development is highly desired. Furthermore the generated or reproduced dots and lines must exhibit a well-shaped form and sharp edges.

This most desired combination of high contrast and excellent dot quality is commonly termed "lith quality". The goal of achieving optimal lith quality is reached by the combination of specially designed graphic arts materials and appropriate processing systems. A first group of such processing systems consists of the traditional lith developers. characterized by the presence of hydroquinone as the sole developing agent and a low but critical sulphite ions content giving rise to an infectious development mechanism, as was described by Yule in *The Journal of the Franklin Institute*, Vol. 239. p. 221–223. (1945). This type of development is believed to proceed autocatalytically. The low concentration of sulphite is maintained by the progressive dissociation of an aldehyde-bisulphite adduct. However these conventional lith developers are rather instable in time and require complicated replenishment systems for both oxidation and exhaustion. Furthermore their developing capacity is limited due to the fact that they contain hydroquinone as the sole developing agent.

In more recent times so-called "hard dot Rapid Access" developers were introduced on the market which combine a good stability with a lith quality, in the reproduction of lines and screen dots. Examples of such developers and corresponding appropriate photographic materials include the GRANDEX system, marketed by FUJI PHOTO Ltd, AGFASTAR, marketed by AGFA-GEVAERT N.V. and the ULTRATEC system marketed by EASTMAN KODAK Co. Some of these systems make use of the contrast promoting action of hydrazine derivatives known for long time in the photographic art. As described by Simpson et al., U.S. Pat. No. 4,650,746, use of a hydrazine compound permits the use of an auxiliary developing agent in combination with the hydroquinone type of developing agent so that the development capacity can be increased. It also permits the presence of a relatively high sulphite concentration in order to protect the developer against aerial oxidation and thereby prolonging its effective working life. Further early disclosures on hydrazine compounds, incorporated either in a photographic element or in a developing solution include Smith U.S. Pat. No. 2,410,690, Stauffer U.S. Pat. No. 2,419,974, Trivelli U.S. Pat. No. 2,419,975 and Hunsberger U.S. Pat. No. 2,892,715 and an article by Stauffer Smith and Trivelli entitled "The influence of photographic developers containing hydrazine upon the characteristic curves of photographic materials",*The Journal of the Franklin Institute*, Vol. 238, p. 291–298, Oct. 1944. Since then the photographic world has undertaken extensive research on hydrazine chemistry for use in photographic applications and the recent patent literature on new hydrazine derivatives and on the combination of known or new hydrazines with other useful ingredients in photographic elements or developers is abundant.

A practical early recognized problem was caused by the high pH levels needed for developers containing hydrazine compounds or used with photographic elements containing these compounds in order to get the maximum effect on contrast. The teaching of Nothnagle U.S. Pat. No. 4.269.929 brought a solution to this problem. Here a method for high contrast development was disclosed involving a hydrazine compound either in the photographic element or in the developer, said developer further containing a hydroquinone developing agent, a 3-pyrazolidinone developing agent, sulphite ions, and a "contrast-promoting amount" of an amino compound. In a preferred embodiment the hydrazine compound was incorporated in the photographic material. According to this patent, issued May 26, 1981, this particular combination of ingredients allows the use of a rather moderate alkaline pH for the developing solution while retaining the desired high contrast and dot quality characteristics. In this way an excellent combination of lith quality of the finished material, high developing capacity and long effective life of the developer was achieved.

The present invention represents a further improvement in the teachings of U.S. Pat. No. 4,269,929. In graphic arts recording materials, intended for camera use, there is a permanent need for higher sensitivity while maintaining reduced fog high contrast and good dot quality. Higher sensitivity simply results in shorter exposure times which forms an evident cost and time saving measure for every user involved in this kind of pre-press activity. On the other hand a higher intrinsic sensitivity results if desired in a shorter developing time which again constitutes an economically favourable feature in pre-press work-flow. As still another alternative any extra gain in sensitivity can be reduced to its original value by incorporating so-called acutance or anti-halation dyes in the photographic material, promoting the sharpness characteristics of said material by reducing light scattering. In this way the edge quality of lines and screen dots can be improved. However classical ways for enhancing sensitivity show some distinct drawbacks. When for example the speed is enhanced by increasing the average grain size of the emulsion grain population there is a tendency to a decrease of gradation and an increase of fog. On the other hand when one tries to enhance the speed by increasing the concentration of the hydrazine compound there is a dangerous tendency to a higher level of black pepper spots in the finished processed image. So there is a permanent need for new methods to improve the sensitivity of graphic arts materials without adversely affecting the lith characteristics and the overall picture quality.

It is an object of the present invention to provide a method for high contrast development involving hydrazine chemistry which produces an enhanced sensitivity while retaining or even improving the high gradation and dot quality properties.

It is a further object of the present invention to provide a method for enhancing this sensitivity without adversely affecting the level of black pepper spots.

It is still a further object of this invention to provide developing solutions for use in accordance with this method.

Further objects will become apparent from the description hereafter.

SUMMARY OF THE INVENTION

The objects of the present invention are realized by a method for high contrast development of an image-wise exposed photographic element comprising a support and at least one silver halide emulsion layer which method comprises contacting said exposed element in the presence of a hydrazine compound with an aqueous alkaline developing solution which has a pH between 10 and 13 and contains a dihydroxybenzene developing agent a 3-pyrazolidinone or an aminophenol developing agent, sulphite ions and a contrast promoting amount of an amino compound characterized in that said developing solution further contains an aprotic solvent corresponding to general formula (I) or (II) :

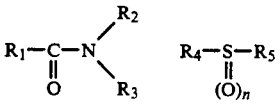

(I) (II)

wherein $R_1$ represents alkyl, substituted alkyl, alkylamino or substituted alkylamino, and $R_2$ and $R_3$ each independently represent alkyl, substituted alkyl, or wherein $R_1$ together with $R_2$ represent the necessary atoms to form, together with the carbon and the nitrogen atom respectively to which they are attached, a heterocyclic ring, and $R_3$ represents alkyl, substituted alkyl or hydrogen:

$R_4$ and $R_5$ each independently represent, alkyl, substituted alkyl, alkylamino or substituted alkylamino or $R_4$ together with R represent the necessary atoms to form together with the sulphur atom to which they are attached a heterocyclic ring and n is 1 or 2.

The hydrazine compound used in connection with the present invention can be incorporated in the photographic material or in the developing solution.

In the prior art the presence of some organic solvents in developers used in connection with hydrazine chemistry has been described e.g. in U.S. Pat. No. 4,569,904, U.S. Pat. No. 4,863,830, U.S. Pat. No. 4,668,605 and DE No. 3 908 835: such organic solvents include ethyleneglycol, diethyleneglycol triethyleneglycol dimethylformamide methyl cellosolve, hexylene glycol methanol and ethanol. It is however the first time that aprotic solvents corresponding to general formula (I) or (II) are described as ingredients in this kind of developers and that their surprising effect on the sensitivity of appropriate photographic elements is recognized.

By the presence of the aprotic solvents in the developing solutions used in accordance with the present invention a sensitivity increase is obtained while retaining or even improving the lith quality characteristics and without adversely affecting the level of black peppers spots as will be clarified by the detailed description and examples following hereafter.

DETAILED DESCRIPTION OF THE INVENTION

Examples of specifically preferred aprotic solvents for use in accordance with the present invention are the following:

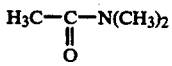

N,N'-dimethylacetamide

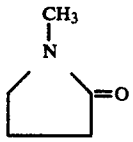

N-methyl-2-pyrrolidinone

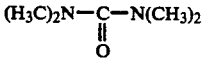

tetramethylurea

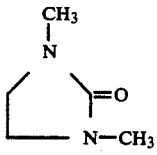

1,3,-dimethyl-2-imidazolidinone

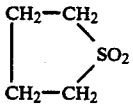

tetramethylenesulphon

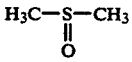

dimethylsulphoxide

The aprotic used solvents in connection with the present invention are readily water-mixable. So they simply can be added to the developing solution by stirring. The solvent are preferably present in a vol % range of 1% to 10%.

Examples of chemical classes of hydrazine compounds for use in accordance with the present invention are enumerated in U.S. Pat. No. 4.269.929 cited above. Preferred classes are acylhydrazides more in particular formylhydrazides, and hydrazines containing an adsorption promoting moiety. Other useful hydrazine derivatives have been disclosed in e.g. Research Disclosure Item 23510 Vol. 235, Nov. 10, 1983. and in numerous patents including U.S. Pat. No. 4,224,401, U.S. Pat. No. 4,243,739, U.S. Pat. No. 4,272,614 and U.S. Pat. No. 4,385,108. Recently new hydrazine derivatives or new combinations with other useful ingredients have been disclosed in e.g. EP No. 0 254 195 U.S. Pat. No. 4,915,354, DE No. 3 829 078 EP No. 0 196 626, EP No.

0 311 009, U.S. Pat. No. 4,816,373, U.S. Pat. No. 4,686,167, EP No. 0 351 077, U.S. Pat. No. 4,833,064, U.S. Pat. No. 4,937,160, U.S. Pat. No. 4,912,016, U.S. Pat. No. 4,950,578, U.S. Pat. No. 4,975,354, and Japanese Unexamined Patent Publication Nos. 63-306438 63-234245 63-234244, 01-105941, 01-179982, 01-201650, 01-235943. These hydrazine compounds can likewise be used in the present invention.

As stated above the hydrazine compounds can be incorporated in the photographic element, which constitutes the preferred embodiment. or in the developing solution. In the case of incorporation in the photographic material the hydrazine molecule preferably contains one or more ballasting groups in order to immobilize the compound in the photographic layer during coating and processing. Preferred hydrazines for incorporation in the photographic material are :

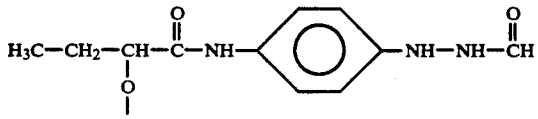

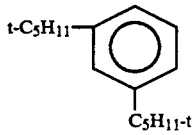

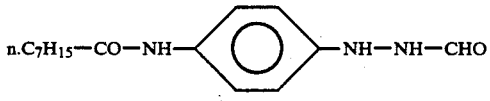

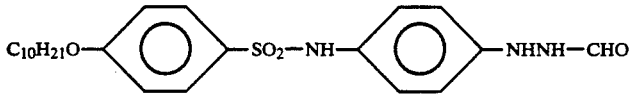

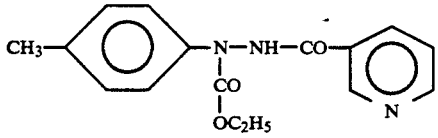

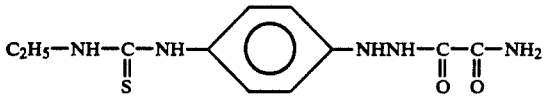

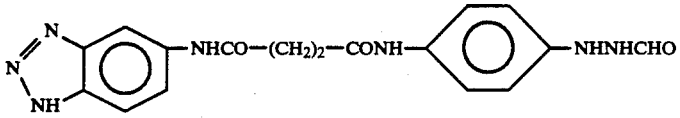

The concentration range of the hydrazine derivatives present in the photographic material preferably ranges from $2.10^{-5}$ to $2.10^{-2}$ mole per mole of silver halide and most preferably from $5.10^{-4}$ to $5.10^{-3}$ mole per mole of silver halide.

Preferred hydrazine compounds for use in a developing solution include

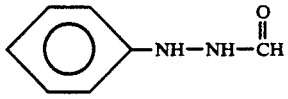

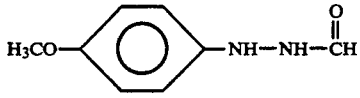

Preferably the concentration of a hydrazine in the developer is comprised between $2.10^{-5}$ mole/liter and $2.10^{-2}$ mole/liter solution.

Amino compounds useful as contrast-promoting compounds in the practice of the invention can belong to widely varying chemical classes. Inorganic amines like hydroxylamines are possible. Useful organic amines include aliphatic amines aromatic amines cyclic amines mixed aliphatic-aromatic amines or heterocyclic amines. Primary, secondary and tertiary amines as well as quaternary ammonium salts are contemplated. A preferred class is formed by the alkanolamines. Specific useful examples of amino compounds are enumerated in U.S. Pat. No. 4,269,929 col. 8 and 9. Most preferred examples include :

3-diethylamino-1,2-propanediol n.butyl-diethanolamine
5-amino-1-pentanol
2-methylamino-1-ethanol
3-dimethylamino-1,2,-propanediol
di-isopropylamine.

In contrast with conventional lith developers the developers for use in accordance with the present invention contain a substantial amount of sulphite preservative. Preferably an alkali sulphite is used e.g. sodium sulphite in a concentration of preferably at least 0.3 mole/liter.

Of the dihydroxybenzene developing agents the most commonly used is hydroquinone. Other useful derivatives include chlorohydroquinone, bromohydroquinone, methylhydroquinone and others. Preferred compounds of the 3-pyrazilidinone class are 1-phenyl-3-pyrazolidinone ("Phenidone") 1-phenyl-4,4'-dimethyl-3-pyrazolidinone 1-phenyl-4-methyl-4'-hydroxymethyl-3-pyrazolidinone and 1-phenyl-4,4'-dihydroxymethyl-3-pyrazolidinone.

As an alternative the auxiliary superadditive developing agent can be an aminophenol e.g. N-methyl-p-aminophenol.

Apart from the aprotic solvent of the present invention the developing solutions may contain a minor volume percentage of an organic solvent e.g. serving as an aid solvent for the hydrazine compound. Typical organic solvents include ethyleneglycol diethyleneglycol, triethyleneglycol dimethylformamide, methyl cellosolve, hexylene glycol, methanol and ethanol.

In a preferred embodiment of the present invention an alkali bromide salt. e.g. sodium bromide is present in the developing solution preferably in a concentration ranging from 0.01 moles to 0.5 moles per liter and most preferably in a range from 0.02 to 0.2 moles per liter.

In an other preferred embodiment of the present invention at least one so-called antifogging agent or stabilizer is present in the developing solution. Numerous chemical classes of stabilizers are known in the photographic art. Suitable examples are e.g. the heterocyclic nitrogen-containing compounds such as benzotriazoles, benzothiazolium salts, nitroimidazoles, nitrobenzimidazoles, nitroindazoles chlorobenzimidazoles, bromobenzimidazoles, mercaptothiazoles, mercaptobenzothiazoles, mercaptobenzimidazoles, mercaptothiadiazoles, aminotriazoles, nitrobenzotriazoles, mercaptotetrazoles, mercaptopyrimidines, mercaptotriazines, benzothiazoline-2-thiones and oxazoline-thiones. Preferred anti-fogging agents are benzotriazole derivatives and mercapto-group containing heterocyclic substances: most preferably 1-phenyl-5-mercapto-tetrazole is used preferably in a concentration range from 10 mg/l to 1 g/l and most preferably in a range from 20 to 250 mg/l.

The alkaline pH values of the developing solutions used in connection with the present invention are preferably established by means of conventional buffering agents like phosphate buffers, carbonate buffers and borax buffers.

Other adjuvants well known to those skilled in the art may be added to the developer liquid used in accordance of the present invention. A survey of conventional developer addenda is given by Grant Haist in "Modern Photographic Processing"—John Wiley and Sons—New York (1979) p. 220–224. Examples of such addenda include complexing agents for calcium and magnesium ions, present in hard water, e.g. ethylene diamine tetraacetic acid and analogues compounds. Further can be present anti-foaming agents, surface-active agents, biocides, thickening agents like polystyrene sulphonate and antioxidants like benzoate and cyclodextrine. The developing liquid can contain so-called anti-sludge agents in order to reduce dirt streaks on developed photographic material. Finally the solution can contain development accelerating agents like polyalkyleneoxides and hardening agents including latent hardeners.

The photographic elements producing high contrast on development by the method of the present invention can be composed of one single emulsion layer, as is the case for many applications or they can be built up by two or even more emulsion layers. Beside the light sensitive emulsion layer(s) the photographic material can contain several non-light sensitive layers e.g. a protective layer, one or more backing layers one or more subbing layers, and one or more intermediate layers e.g. filter layers.

The emulsions present in these photographic materials are of the negative working type forming a surface latent image. They can be of any halide composition. e.g. chlorobromide or chlorobromoiodide emulsions as is the case with conventional lith emulsions, as well as bromide or bromoiodide emulsions which are preferred for graphics art camera materials because of their intrinsic higher sensitivity. In the case of reprographic duplicating materials the emulsions usually contain a high amount of chloride and can be doped with a Group VIII metal. e.g. Rhodium or Iridium.

The silver halide emulsions under consideration can be spectrally sensitized with methine dyes such as those described by F. M. Hamer in "The Cyanine Dyes and Related Compounds", 1964. John Wiley & Sons. Dyes that can be used for the purpose of spectral sensitization include cyanine dyes merocyanine dyes complex cyanine dyes complex merocyanine dyes, hemicyanine dyes styryl dyes and hemioxonol dyes. Particularly valuable dyes are those belonging to the cyanine dyes, merocyanine dyes and complex merocyanine dyes. For camera recording applications the emulsions usually contain a sensitizer for the green spectral region.

The silver halide emulsions under consideration can be stabilized by representatives of the same chemical classes which can be present in the developing solutions as enumerated above. Other preferred compounds include triazaindenes, tetrazaindenes and pentazaindenes especially those described by Birr in Z. Wiss. Phot. 47 (1952), pages 2–58.

The gelatin binder of these photographic elements can be hardened with appropriate hardening agents such as those of the epoxide type, those of the ethylenimine type, those of the vinylsulfone type e.g. 1,3-vinylsulphonyl-2-propanol, chromium salts e.g. chromium acetate and chromium alum. aldehydes e.g. formaldehyde, glyoxal and glutaraldehyde N-methylol compounds e.g. dimethylolurea and methyloldimethylhydantoin dioxan derivatives e.g. 2,3-dihydroxydioxan, active vinyl compounds e.g. 1,3,5-triacryloylhexahydro-s-triazine, active halogen compounds e.g. 2,4 dichloro-6-hydroxy-s-triazine, and mucohalogenic acids e.g. mucochloric acid and mucophenoxychloric acid. These hardeners can be used alone or in combination. The binder can also be hardened with fast-reacting hardeners such as carbamoylpyridinium salts as disclosed in U.S. Pat. No. 4,063,952 and with the onium compounds as disclosed in European Patent Application No 90.201850.6

The photographic elements under consideration may further comprise various kinds of surface-active agents in the photographic emulsion layer or in at least one other hydrophilic colloid layer. Preferred surface-active coating agents are compounds containing perfluorinated alkyl groups.

The photographic elements may further comprise various other additives such as e.g. compounds improving the dimensional stability of the photographic element, UV-absorbers spacing agents and plasticizers.

As stated above the photographic material can contain several non light sensitive layers e.g. an anti-stress top layer, one or more backing layers, and one or more intermediate layers eventually containing filter- or anti-halation dyes that absorb scattering light and thus promote the image sharpness. Suitable light-absorbing dyes are described in e.g. U.S. Pat. No. 4,092,168, U.S. Pat. No. 4,311,787, DE No. 2,453,217, and GB No. 7 907 440. One or more backing layers can be provided at the non-light sensitive side of the support. These layers which can serve as anti-curl layer can contain e.g. matting agents like silica particles, lubricants antistatic agents light absorbing dyes, opacifying agents, e.g. titanium oxide and the usual ingredients like hardeners and wetting agents.

The support of the photographic material may be opaque or transparent e.g. a paper support or resin support. When a paper support is used preference is given to one coated at one or both sides with an Alpha-olefin polymer e.g. a polyethylene layer which optionally contains an anti-halation dye or pigment. It is also possible to use an organic resin support e.g. cellulose nitrate film, cellulose acetate film, polyvinylacetal film polystyrene film, polyethylene terephthalate film polycarbonate film, polyvinylchloride film or poly-Alpha-olefin films such as polyethylene or polypropylene film. The thickness of such organic resin film is preferably comprised between 0.07 and 0.35 mm. These organic resin supports are preferably coated with a subbing layer which can contain water insoluble particles such as silica or titanium dioxide.

The high contrast photographic materials to be developed by the method of the present invention can be image-wise exposed by any convenient radiation source in accordance with its specific application.

For processing preferably an automatically operating apparatus is used provided with a system for automatic replenishment of the processing solutions. The development step can be followed by a washing step. a fixing step, preferably performed by means of a conventional ammonium or sodium thiosulphate containing fixing solution, and another washing or stabilization step. Finally the photographic material is dried.

The following examples illustrate the invention without however limiting it thereto.

EXAMPLE 1

A cubic grain type iodobromide emulsion containing 1% iodide and having an average grain size of 0.3 micron was coated on a subbed polyethylene terephtalate support at a coverage of silver halide equivalent to 3.2 Ag/m$^2$ and a coverage of 2.7 gelatine/m$^2$. The emulsion was spectrally sensitized by means of 5,5'-dichloro-9-ethyl-3,3'-bis-(3-sulphopropyl)-oxacarbocyanine-sodium salt and stabilized by means of 4-hydroxy-6-methyl-(1,3,3a,7)-tetraazaindene.

The emulsion layer further contained the hydrazine compound 1-formyl-2-[4-[2-(2,4-di-t.pentylphenoxy)-butyramidol-phenyl]-hydrazide polyethylene glycol, and polethylacrylate latex.

The emulsion layer was coated with a protective layer containing 1.0 g/m$^2$ of gelatin hardened by means of methylene-bis-(sulphonylethylene).

Samples of the thus prepared material were exposed in a vertical camera REPROMASTER RPS 2001 marketed by AGFA-GEVAERT on the one hand through a continuous tone wedge and on the other hand through a grey negative screen wedge having a screen ruling of 54 lines/cm. The exposed samples were processed in a tray during 35 seconds at 38° C. using a developer having the following composition:

| | |
|---|---|
| ethylenediamine-tetraacetic acid-sodium salt | 1 g |
| phosphoric acid | 27 ml |
| sodium sulphite anh. | 67 g |
| 5-methylbenzotriazole | 0.2 g |
| hydroquinone | 30 g |
| 1-phenyl-4-methyl-4'-hydroxymethyl-3-pyrazolidinone | 0.25 g |
| 3-diethylamino-1,2-propanediol | 20 ml |
| 1-phenyl-5-mercapto-tetrazole | 0.03 g |
| sodium bromide | 3.3 g |
| water to make | 1 l |
| pH adjusted to 11.5 with KOH. | |

After development the samples were fixed for 3 min at 25° C. in a tray using a fixing solution having the following composition:

| | |
|---|---|
| ammonium thiosulphate anh. | 100 g |
| sodium sulphite anh. | 10 g |
| boric acid | 5 g |
| sodium acetate | 15 g |
| acetic acid glacial | 8 ml |
| water to make | 1 l |

To the developer solution were added 50 ml/l of aprotic solvents according to the invention as specified in Table 1 below. The pH was readjusted to 11.5 with potassium hydroxide. Developing solution A of Table 1 does not contain an aprotic solvent and developing solution B contains an aprotic solvent not corresponding to general formula (I) of the invention.

In said table 1 the photographic speed is expressed in relative arithmetic values (rel. S) measured at density 3.0 above fog, whereby the value of comparison sample A is set arbitrarely to 100. Higher number means higher sensitivity .

Gradient values in the toe ($g_t$) of the sensitometric curve were measured between the log exposure values at densities 0.1 and 0.6 above fog. Straight-line gradients (grad) were measured between the log exposure values at densities 0.3 and 3.0 above fog.

The screen dot quality was assessed and the rating expressed by arbitrary numbers between 0 and 5 wherein increasing numbers stand for degrading quality. Number 0 stands for developed screen dots having high optical density and sharp, non-indented edges. The other numbers relate to screen dots having gradually reduced optical density and dot edges with increased indentation and fuzzy structure. Above rating 3 the quality is considered to be no longer commercially acceptable.

TABLE 1

| Dev. Sol. | aprotic solvent | sensitometry fog | rel. S | $g_t$ | grad | dot rating |
|---|---|---|---|---|---|---|
| A | | 0.03 | 100 | 6.6 | 19.3 | 1-2 |
| B | diethyleneglycol | 0.03 | 100 | 5.4 | 18.5 | 1-2 |
| C | N,N'-dimethylacetamide | 0.03 | 191 | 8.3 | 22.5 | 1 |
| D | N-methyl-2-pyrrolidinone | 0.03 | 162 | 8.1 | 23.5 | 1-2 |
| E | tetramethylurea | 0.03 | 191 | 8.4 | 21.5 | 1 |
| F | 1,3,-dimethyl-2-imidazolidinone | 0.03 | 214 | 7.5 | 21.5 | 1-2 |
| G | tetramethylenesulphon | 0.03 | 152 | 7.1 | 19.7 | 1-2 |

It is apparent from table 1 that higher speeds, higher gradations and equal or better dot quality ratings are obtained with the developing solutions C to G than with the comparative developing solutions A and B. No black pepper spots were present in the processed samples C to G.

EXAMPLE 2

Developing solutions H to K were prepared containing the same basic composition as in example 1 with the proviso that rising amounts of the aprotic solvent N-methyl-pyrrolidinone (NMP) were added to the developer solutions. For each sample, the pH was adjusted to 11.5 by means of potassium hydroxide. The photographic properties were measured as in example 1 and are represented in table 2.

TABLE 2

| Dev. Sol. | amount of NMP | sensitrometry fog | rel. S | $g_t$ | grad | dot rating |
|---|---|---|---|---|---|---|
| A | 0 | 0.03 | 100 | 6.6 | 19.5 | 1-2 |
| H | 5 | 0.03 | 115 | 6.7 | 20.8 | 1-2 |
| I | 20 | 0.03 | 138 | 7.6 | 23.0 | 1-2 |
| J | 50 | 0.03 | 162 | 8.1 | 23.5 | 1-2 |
| K | 100 | 0.03 | 220 | 10.4 | 19.8 | 1-2 |

The results represented in table 2 illustrate clearly that higher speeds and higher gradients can be obtained without enhancing the fog level or lowering dot quality. No black pepper spots appeared in the finished images of samples H to K.

EXAMPLE 3

A fine grain emulsion composed of 83.6% of chloride 16% of bromide and 0.4% of iodide doped with $10^{-7}$ mole/mole silver of a Rhodium salt and showing an average grain size of 0.3 micron was coated on a subbed polyethylene terephtalate support at a gelatin coverage of 3.6 g/m$^2$ and a silver halide coverage equivalent to 4.1 g Ag/m$^2$ The emulsion was chemically sensitized with gold(III)chloride and sodium thiosulphate stabilized with 4-hydroxy-6-methyl (1,3,3a.7)-tetraazaindene and spectrally sensitized for the red spectral region. The emulsion layer further contained the hydrazine compound 1-formyl-2-(4-methylphenyl)-hydrazine and polyethylacrylate latex. Finally a protective layer containing gelatine at a coverage of 1 g/m$^2$ was coated over the emulsion layer and hardened by means of formaldehyde.

Samples of the photographic material prepared as described were exposed by contact in a VAKUPRINT S65 exposing unit, marketed by KLIMSCH Co. on the one hand through a continuous tone wedge, on the other through a grey negative screen wedge having a screen ruling of 54 lines/cm. The development proceeded by dipping the exposed photographic samples into a tray for 45 seconds at a temperature of 30 ° C. using a developer corresponding to developer D from example 1. containing 50 ml N-methyl-pyrrolidinone. Other samples were developed in control developer A containing no aprotic solvent. The samples were fixed in the same fixing solution as in example 1. The sensitometric properties and the dot quality ratings were measured and expressed as in example 1. The results are summarized in table 3 :

TABLE 3

| Dev. Sol. | Sensitometry fog | rel. S | $g_t$ | grad | Dot rating |
|---|---|---|---|---|---|
| A | 0.06 | 100 | 3.8 | 5.2 | 3 |
| B | 0.07 | 151 | 5.0 | 6.3 | 3 |

Again the results from table 3 illustrate the gain in speed and gradation by the incorporation in the developer of an aprotic solvent in connection with the invention without negative effect on the dot quality.

We claim:

1. A method for high contrast development of an image-wise exposed photographic element comprising a support and at least one silver halide emulsion layer, which method comprises contacting said exposed element in the presence of a hydrazine compound with an aqueous alkaline developing solution which has a pH between 10 and 13 and contains a dihydroxybenzene developing agent, a 3-pyrazolidinone or an aminophenol developing agent, sulphite ions and a contrast promoting amount of an amino compound characterized in that said developing solution further contains an aprotic solvent corresponding to general formula (I) or (II) :

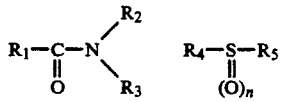

(I) (II)

wherein $R_1$ represents alkyl, substituted alkyl, alkylamino, or substituted alkylamino, and $R_2$ and $R_3$ each independently represent alkyl substituted alkyl or wherein $R_1$ together with $R_2$ represent the necessary atoms to form together with the carbon and the nitrogen atom respectively to which they are attached a heterocyclic ring and $R_3$ represents alkyl substituted alkyl or hydrogen:

$R_4$ and $R_5$ each independently represent, alkyl, substituted alkyl, alkylamino or substituted alkylamino, or $R_4$ together with $R_5$ represent the necessary atoms to form together with the sulphur atom to which they are attached a heterocyclic ring, and n is 1 or 2.

2. Method according to claim 1 wherein said aprotic solvent is present in said developing solution in a concentration from 1 volume percent to 10 volume percent.

3. Method according to claim 1 wherein said aprotic solvent is a member selected from the group consisting of N,N'-dimethylacetamide. N-methyl-2-pyrrolidinone, tetramethylurea, 1,3,-dimethyl-2-imidazolidinone, dimethylsulphoxide and tetramethylenesulphon.

4. Method according to claim 1 wherein said hydrazine compound is present in said photographic element.

5. Method according to claim 4 wherein said hydrazine compound is present in the photographic element in a concentration from $2.10^{-5}$ mole to $2.10^{-2}$ mole per mole silver halide.

6. Method according to claim 1 wherein said hydrazine compound is present in said aqueous alkaline developing solution.

7. Method according to claim 6 wherein said hydrazine compound is present in said developing solution in a concentration ranging from $2.10^{-4}$ mole/liter to $2.10^{-2}$ mole/liter.

8. Method according to claim 1 wherein said sulphite ions are present in said developing solution in a concentration of at least 0.3 mole/liter.

9. Method according claim 1 wherein said amino compound is an alkanolamine.

10. Aqueous alkaline developing solution for use in high contrast development of an image-wise exposed photographic element, said solution having a pH between 10 and 13 and containing a dihydroxybenzene developing agent, a 3-pyrazolidinone or an aminophenol developing agent sulphite ions a contrast promoting amount of an amino compound and an aprotic solvent corresponding to general formula (I) or (II) :

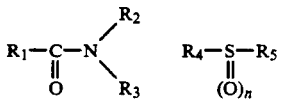

(I) (II)

wherein $R_1$ represents alkyl, substituted alkyl, alkylamino or substituted alkylamino, and $R_2$ and $R_3$ each independantly represent alkyl, substituted alkyl or wherein $R_1$ together with $R_2$ represent the necessary atoms to form together with the carbon and the nitrogen atom respectively to which they are attached, a heterocyclic ring, and $R_3$ represents alkyl, substituted alkyl or hydrogen:

$R_4$ and $R_5$ each independantly represent, alkyl, substituted alkyl, alkylamino or substituted alkylamino, or $R_4$ together with $R_5$ represent the necessary atoms to form together with the sulphur atom to which they are attached a heterocyclic ring, and n is 1 or 2.

11. Aqueous alkaline solution according to claim 10 wherein said aprotic solvent is present in a concentration ranging from 1 volume percent to 10 volume percent.

12. Aqueous alkaline developing solution according to claim 10 wherein said aprotic solvent is a member selected from the group consisting of N,N'-dimethylacetamide N-methyl-2-pyrrolidinone tetramethylurea, 1,3,-dimethyl-2-imidazolidinone, dimethylsulphoxide and tetramethylenesulphon.

13. Aqueous alkaline developing solution according to claim 10 wherein said hydrazine compound is present in a concentration ranging from $2.10^{-4}$ mole/liter to $2.10^{-2}$ mole/liter.

14. Aqueous alkaline developing solution according to claim 10 wherein said sulphite ions are present in a concentration of at least 0.3 mole/liter.

15. Aqueous alkaline developing solution according to claim 10 wherein said amino compound is an alkonolamine.

* * * * *